US007300499B1

(12) United States Patent
Fleisher

(10) Patent No.: US 7,300,499 B1
(45) Date of Patent: Nov. 27, 2007

(54) AIRPLANE AIR PURIFIER

(76) Inventor: Aaron L. Fleisher, 47 Panorama Crest Ave., Las Vegas, NV (US) 89135

( * ) Notice: Subject to any disclaimer, the term of this patent is extended or adjusted under 35 U.S.C. 154(b) by 0 days.

(21) Appl. No.: 11/437,557

(22) Filed: May 19, 2006

(51) Int. Cl.
*B03C 3/016* (2006.01)

(52) U.S. Cl. ..... 96/16; 96/55; 96/224; 422/186.04; 422/186.3

(58) Field of Classification Search ..... 96/16, 96/55, 80, 96, 224; 422/24, 121, 186.04, 422/186.3
See application file for complete search history.

(56) References Cited

U.S. PATENT DOCUMENTS 3,403,252 A * 9/1968 Nagy ..... 361/231
3,798,879 A * 3/1974 Schmidt-Burbach et al. .. 96/16
3,844,741 A * 10/1974 Dimitrik ..... 96/16
4,203,948 A * 5/1980 Brundbjerg ..... 422/121
4,990,313 A * 2/1991 Pacosz ..... 96/224
5,240,478 A * 8/1993 Messina ..... 95/273
5,433,772 A * 7/1995 Sikora ..... 96/87
5,993,738 A * 11/1999 Goswani ..... 422/22
6,063,170 A * 5/2000 Deibert ..... 96/224
6,149,717 A * 11/2000 Satyapal et al. ..... 96/16
6,322,614 B1 * 11/2001 Tillmans ..... 96/16
6,623,544 B1 * 9/2003 Kaura ..... 95/3
2006/0078476 A1 * 4/2006 Yuen ..... 422/123

FOREIGN PATENT DOCUMENTS

GB 2036951 A * 7/1980 ..... 96/16

* cited by examiner

*Primary Examiner*—Richard L. Chiesa
(74) *Attorney, Agent, or Firm*—Raymond M. Galasso; Galasso & Associates, LP

(57) ABSTRACT

An airplane air purifier employs high voltage electrostatic ionic air charging grid and precipitator plates for the removal of particulates and contaminants, together with germicidal capabilities provided by an ultraviolet wavelength band UVC illuminator within the purifier. The purifier is adapted to operate from the aircraft passenger cabin electrical supply or alternately from replaceable or rechargeable batteries. The purifier provided with one or more nozzle adapters to removably and supportively install the air purifier to the typical varieties of aircraft passenger air vent nozzles. The air purifier is small in size and light in weight so as to be easily carried onboard the flight and installed without issue to the air vent nozzle, whereby the air purifier purifies the ducted cabin air in the plane before diffusing into the passenger's breathing air space.

8 Claims, 2 Drawing Sheets

AIRPLANE AIR PURIFIER

FIELD OF THE DISCLOSURE

The disclosures made herein relate generally to the field of air filters and purifiers and, more specifically, to the portable ionic air purifiers adapted to electronically remove contaminants from an air stream emitting from a passenger air vent in a commercial aircraft.

BACKGROUND

Ionic air purifiers are available in various sizes, such as floor standing or desktop units designed to clean the air within a room, to larger units designed to install into the heating and ventilation system of a residential or commercial building.

Ionic air purifiers pass an inlet air stream over one or more ionizing wires or an ionizing wire grid. The ionizing wires impart an electrical charge to the air flow, creating charged molecules known as ions, some of which eventually cling to airborne particles. In the case of air ionizers, the charged air is released as treated air. More sophisticated types of air purifiers include an electronic precipitator. Electronic precipitators add a set of oppositely charged particle collection plates, the plates having an electric charge opposite to that of the ionizing wires, and hence opposite to the charge of the particles reaching the plates. The oppositely charged collection plates attract the charged particles from the ionizing wires and due to the static charge, deposit the particles removed from the air stream onto the precipitator plates. In the precipitator type of air purifier, the precipitator plates must be cleaned at regular intervals of use to remove the accumulated particulate debris from the plates. A drawback of electronic ionic air purifiers is that all ionic purifiers generate some amount of ozone. Ozone is produced as a byproduct by the high voltage present at the ionizing wires as the high voltage converts oxygen into ozone.

Ionic air purifiers clean the air by electro statically removing both visible and invisible particles as small as 1/1000th (0.001) of a micron. These include allergy-causing pollens, exhaust and tobacco smoke, dust and even airborne bacteria.

An airplane passenger or crew cabin provides a unique environment compared to the conditions that most people encounter in their daily lives. The density of occupation in the passenger cabin is much higher than in any but the most crowded bars and theatres, and the available air volume is limited, as well as only a limited volume of make up air to replace stale cabin air. The relative humidity level in the aircraft cabin is generally lower than is encountered in buildings in any but the coldest parts of the world in winter due to the low temperatures outside the aircraft and low atmospheric pressure compared to the aircraft interior. In the cabin environment, as in any environment, thermal conditions as well as air pollutants and humidity levels affect the perceived air quality, and then there are the real air quality concerns of bacterial, particulate and chemical contamination either carried on board with the passengers or remaining in the aircraft fuselage and air vent passages from previous flights. The closed cabin and high density of occupation, together with the recirculation of the cabin air provides an efficient means of dispersing germs and viruses from sick passengers to those who are not yet infected but are now at risk within the airplane.

Aircraft air quality is a real problem for millions of travelers and thousands of airline employees. In recent years, a report from the National Research Council found evidence suggesting that a number of problems with the air circulating in passenger cabins may cause health problems. The report listed concerns that ozone levels in the cabin air may exceed regulatory standards, that oxygen pressure may not be adequate to protect passengers with pre-existing heart or respiratory diseases and that the air may be contaminated with traces of engine oil, hydraulic fluid, de-icing solutions, and even pesticides sprayed on international flights. Not surprisingly, those most affected are flight attendants and other crew members, some of whom have been complaining for years about headaches, blurred vision, dizziness, nausea and other health problems which they attribute to poor quality cabin air. Recently Alaska Airlines flight attendants won a $725,000 out-of-court settlement based on their contention that design flaws in two types of planes the airline flies had allowed chemical fluids to mix with cabin air and make them sick. However, the flight attendants lost a subsequent suit against the planes' manufacturers.

Even more recently and very illustrative of the dangers of aircraft cabin air is an article in Reuters News Service published on Apr. 13, 2006, wherein U.S. public health officials expressed concerned about an unexpected outbreak in mumps in the Midwest United States, and most notably the U.S. public health officials "are concerned that some people may have been infected (with mumps) on airline flights." More than 600 people were reported sick in Iowa with mumps, a once common childhood disease that was believed to be eradicated with the use of measles, mumps and rubella vaccines in the 1950s and 60s. Quoted in the Reuters article, the United States Center for Disease Control (CDC) reports "This outbreak has spread across Iowa, and mumps activity, possibly linked to the Iowa outbreak, is under investigation in six neighboring states, including Illinois (four cases), Kansas (33 cases), Minnesota (one case), Missouri (four cases), Nebraska (43 cases), and Wisconsin (four cases)." Serious complications are associated with mumps, including meningitis, encephalitis, inflammation of the testicles or ovaries, inflammation of the pancreas and permanent deafness, among others. As with other viruses, mumps is transmitted by coughing and sneezing the virus contagions into the air where they are carried and later inhaled by other non-infected passengers. Of course, the high passenger density and closed confines of an aircraft passenger compartment together with the contaminant laden recirculation air system of the plane makes this all too easy. Mumps is "about as contagious as influenza", the CDC said. Especially alarming is that those infected can pass along the virus to others for three days before they exhibit symptoms of the illness themselves, wherein they are not identifiable as ill before boarding the plane. The Reuters article notes that the CDC "said it was tracking two people who took nine flights in April (2006) and asked anyone showing symptoms of mumps to report to state health officials if they had been on the flights." The CDC has begun use of a new system to track travelers who may pass viruses on air flights.

Other Researchers at the University of Pittsburgh Medical Center's Center for Biosecurity are raising concerns with the CDC seeking information on the specifics of the CDC's plans, if any, for the pre-emptive monitoring of international air flight travelers in the case of a pandemic of H5N1 bird flu, which is expected to eventually mutate to transfer easily human to human and has been likened by some in the medical profession to be the potential 'Black Death' of the 2000s.

A limitation of currently known ionic air purifiers is that they are relatively bulky in size and not capable of use onboard an aircraft, where from the above discussion, such a device is sorely needed. For an air purifier to be truly effective for the passenger, the purifier must directly connect to the passenger air vent so as to purify the air stream before it is directed into the passenger's personal breathing space. Conventional air purifiers are bulky, require substantial power to operate, and most importantly they are not directly connectable to an aircraft air vent to clean the ducted cabin air.

A primary means of air purification in ionic air purifiers is the chemical destruction of pollutants by ozone and the electrostatic precipitation of particles as the result of charging of the air stream in the ionizing grid.

A limitation of currently known ionic air purifiers is that they do not have a means to remove residual ozone generated by the ionic purifier from the purified air stream before it returns to the environment. Ozone is a known irritant and needs to be removed from the air stream to the greatest practical degree, especially within contained space of an aircraft.

Therefore, an airplane air purifier which is designed for direct installation over existing aircraft passenger air vent nozzles, a purifier which removes or destroys a wide variety of contaminants, particulate matter, viruses and bacteria, one which is safe to the user and the other passengers on the aircraft, one which provides a solution to the significant health problems associated with aircraft passenger cabin air as outlined in detail above, such an airplane air purifier would be useful and novel.

SUMMARY OF THE DISCLOSURE

Accordingly, embodiments of the inventive disclosures made herein comprise a portable ionic air purifier for installation on the passenger air vents of a commercial or private aircraft.

In a first embodiment of the inventive disclosures herein, the airplane air purifier comprises a ducted air housing having an air inlet end, a germicidal treatment portion, an ionic purification portion, an ozone and chemical filtration portion and an outlet air diffuser, taken in the order of air flow through the housing. Included on the inlet end is a means of removably and supportively coupling the inlet end of the housing to an aircraft air vent nozzle. The air purifier is light weight and small enough in size to be supported by the passenger air vent nozzle in the aircraft. Passenger air vent nozzles in commercial aircraft are typically, although not always, eyeball type swivel vents having a neck portion for positioning the eyeball vent to direct air flow to the passenger. The diameter of the neck on the eyeball vent typically, although not always, is in the range of 1 inch to 1.5 inches in diameter. Embodiments of the subject air purifier is adapted to attach the nozzle of such air vents and to be directly interposed between the aircraft ducted air and the passenger's breathing air space. Preferably the air purifier is provided with one or more vent nozzle adapters, the nozzle adapters removably connectable to the air inlet end of the air purifier, the nozzle adapters in various configurations adapted to interface and attach the air purifier to the variety of aircraft passenger vent nozzles in use on aircrafts flying today wherein embodiments of the subject air purifier are adapted to attach to conventional types of aircraft air vents and intercede between the cabin ducted air supply and the passenger's breathing air space. As air first enters the air purifier, it encounters the germicidal section having an ultraviolet (UV) lamp which emits short wavelength UV light in the germicidal spectrum (UVC). For highest germicidal efficiency the UVC light source should emit at around 260 to 270 nm wavelength. The air duct region surrounding the UVC light source is provided with a UVC reflective material to multiply by reflection the germicidal effect of the UV lamp emissions. Certain embodiments of the subject air purifier are battery operated, and in such battery operated embodiments the UVC lamp is necessarily of limited wattage so as to conserve battery life and limit the space requirements for the UVC lamp. In such battery powered embodiments the use of reflective materials in the germicidal portion of the air purifier are especially beneficial. It is seen as preferable that the aircraft air purifier be powered from the aircraft cabin power supply or the plane as this permits the use of higher wattage and therefore higher UVC intensity germicidal lamps within the air purifier.

After the ultraviolet lamp germicidal portion the air moves into the ionic purification portion of the housing. The air first passes through one or more ionizing wires. The wires are energized at a relatively high voltage of several thousand volts. The ionizing wires impart an electrical charge to the molecules air flow, creating charged molecules known as ions, some of which eventually to cling to airborne particles. A corona created on the ionizing wires generates ozone which is capable of chemically reacting with organic molecules so as to break down organic contaminants, this in addition to the germicidal action of the earlier UVC lamp. The air flow next encounters the electric precipitator or particle collection plates, which are energized in a polarity opposite to that of the ionizing wires. The oppositely charged collection plates attract the charged particles from the ionizing wires and due to the static charge thereon from the inverter of the air purifier, deposits the particles removed from the air stream onto the precipitator plates. The ionizing and precipitator plates are energized by an inverter contained in a portion of the ionic purification portion of the housing. In the case of the 'Z' shaped embodiment, the inverter may be located in a base portion directly under the ionic purification portion. In other embodiments the inverter may be located in the air purifier in a location where space and electrical wire routing best permits. The inverter converts a relatively low voltage supply to the high voltage required to drive the ionizing wires and electrical precipitator plates. In the case of embodiments of the subject air purifier of the present inventive disclosure which are powered by the aircraft passenger cabin electrical supply circuits, this may be a 12 volt or 42 volt direct current supply, or may be a 115 volt alternating current supply, or other voltage supplies as available within the passenger cabin of various airframes in current use. Other embodiments of the subject air purifier can be powered by self contained batteries, either rechargeable or disposable varieties. The low power consumption of the ionic wires and precipitator is quite low, making the powering of the subject air purifier from batteries quite feasible. Depending on the type of germicidal lamp used, the largest consumer of electrical energy in the airplane air purifier can be the germicidal UVC lamp. For example for illustration, using a commonly available germicidal mercury arc UVC GTL3 series miniature lamp having an ANSI standard E17 base lamp powered at 10 volts, the lamp consumes 3 watts, or about 300 mA at 10 volts. In the case of battery powered embodiments, for lower power consumption and on longer flights the UVC lamp can be switched off if desired, although its use is highly desirable. The power consumption of the UVC germicidal lamp is a motivator for the use of externally powered embodiments powered directly from the aircraft cabin electrical supply.

Air flow leaving the precipitator plates in the ionic precipitator portion then enters the ozone and chemical filter portion of the housing. The airplane air purifier is equipped with an activated charcoal filter to help remove odors that may have made it past the ionic purifier, as well as to remove ozone to the extent practical. Ozone is produced by all ionic air purifiers as a byproduct to the air ionization process. Ozone in significant concentrations is an irritant to the human body and it is desirable to reduce its presence in the outlet air stream of the purifier. A limitation of conventional ionic purifiers is that they do not provide a means of removing ozone from the outlet air stream. In the air purifier according to the inventive disclosures herein the purifier is provided with a replaceable activated charcoal filter located after the ionic purifier portion of the housing. Activated charcoal has been tested and shown to be very effective in removing ozone from an air stream directed through the activated charcoal filter. An article as published in the American Industrial Hygiene Association Journal of September, October 1999, summarizes the results of a study at the University of Minnesota on the removal of ozone using activated carbon filters. The findings include the following quotation "Activated carbon filters can be very effective at ozone removal, although not indefinitely because chemical reactions of ozone and carbon change the carbon." Therefore the addition of a user replaceable activated carbon filter following the ionic purifier can be advantageous in two ways, first by absorbing additional odors and chemical from the air stream that may have made it past the ionic purifier and secondly by removing ozone created in the ionic purifier from the air stream and thereby preventing the addition of another chemical irritant to the aircraft cabin air. The combination of the above elements comprises the essential elements of the air purification embodiments of the present inventive disclosures.

The air purifier according to the present invention is designed to operate quietly as it has no moving parts and relies upon the forced air flow through the aircraft air vent to provide the motive force to drive the air through the air purifier.

Filtered and purified air flows then into the outlet portion of the housing where it flows through diffusers and out into the passenger compartment and to the passenger seated below the air purifier.

In a second embodiment of the airplane air purifier particularly suited to low power operation from self contained batteries, the mercury arc UVC lamp is replaced with one or more ultraviolet UVC spectrum rated light emitting diodes (LEDs). The LEDs consume nominally 20 mA each up to 50 mAs each for the 'superflux' LED varieties and so greatly reduces the power drain compared to the GTL3 series or larger more effective UVC lamps as envisioned for use with the present inventive disclosure.

In a third series of embodiments of the airplane air purifier according to the inventive disclosures herein, the airplane air purifier is provided with means of connecting an external direct current power source, eliminating the need for batteries internal to the air purifier housing. Embodiments of the externally powered air purifiers are well supplied with the power to utilize higher wattage UVC lamps such as available UVC rated mercury arc lamps to provide potent germicidal irradiation of the ducted aircraft cabin air.

It is an objective of the present invention to provide an airplane air purifier which is adapted to remove or neutralize virus contagions present in the ducted air systems of aircraft and thereby reduce the risk to the traveling public of exposure to or infection from airborne chemical, bacterial and other contaminants, thereby contributing to the public health and well being.

It is an objective of the present invention to provide an airplane air purifier which is easy to carry onboard an aircraft and which can be easily installed to and removed from a variety of typical commercial plane air vent nozzles.

It is another objective of the present invention to provide an airplane air purifier which in preferred embodiments is operable from the aircraft cabin electrical system such as to allow for the use of higher wattage UVC germicidal lamps.

It is another objective of the present invention to provide an airplane air purifier in certain embodiments which can operate on battery power alone for a reasonable amount of time, the expected onboard duration of a typical air flight.

It is an objective of the present invention to provide an airplane air purifier which is adapted to be powered from conventional alkaline batteries for the duration of a typical flight.

It is an objective of the present invention to provide an airplane air purifier which is adapted to be powered by rechargeable batteries for the duration of a typical flight.

It is another objective of the present invention to provide an airplane air purifier which utilizes a simplified design to reduce cost, weight and size.

It is another objective of the present invention to provide an airplane air purifier which provides radio frequency shielding around the inverter, charging and precipitator plates so as to reduce any chance of generated radio frequency interference onboard the aircraft.

It is another objective of the present invention to provide an airplane air purifier which uses to advantage the forced air flow on the cabin passenger air vent system, and thereby eliminates the weight, power consumption, noise and additional cost of including a fan internal to the air purifier.

It is another objective of the present invention to provide an airplane air purifier having a corona discharge and precipitator collection system for killing pathogens, detoxifying chemical pollutants, and electrostatic capture of undesirable particulates in the air stream.

It is another objective of the present invention to provide an airplane air purifier which incorporates a user replaceable activated carbon after filter to remove or degrade any odors still present in the air stream after the ducted air stream passes through the ionic air purification section of the purifier.

It is another objective of the present invention to provide an airplane air purifier which provides a replaceable activated carbon filter to remove generated ozone from the air stream.

It is another objective of the present invention to provide an airplane air purifier that operates quietly and has no moving parts.

It is another objective of the present invention to provide an airplane air purifier that contributes to the health and safety of the air traveling public.

These and other objects of the invention made herein will become readily apparent upon further review of the following specification and associated drawings.

BRIEF DESCRIPTION OF THE DRAWINGS

The drawings show a form of the invention that is presently preferred; however, the invention is not limited to the precise arrangement shown in the drawings.

DETAILED DESCRIPTION OF THE DRAWINGS

In preparation for explaining the details of the present inventive disclosure, it is to be understood by the reader that the invention is not limited to the presented details of the construction, materials and embodiments as illustrated in the accompanying drawings, as the invention concepts are clearly capable of other embodiments and of being practiced and realized in various ways by applying the disclosure presented herein.

Figure 1:
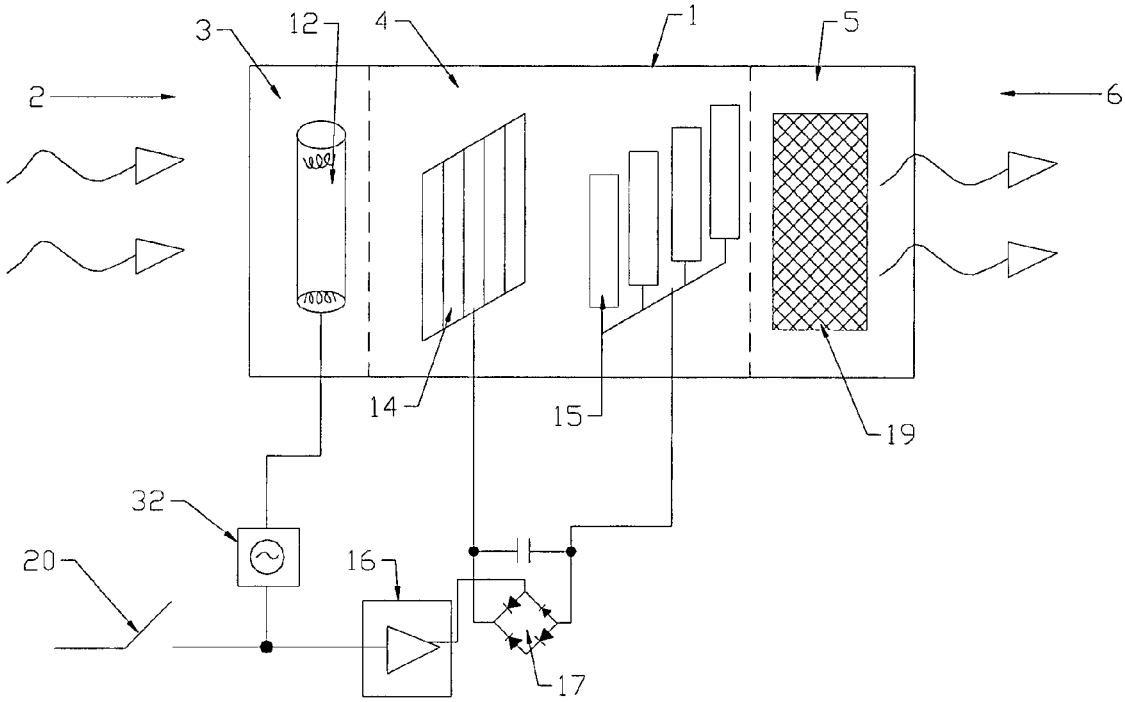
FIG. 1 depicts block diagram single line schematic of the airplane air purifier in accordance with the inventive disclosures presented herein.

FIG. 1 depicts block diagram single line schematic of the airplane air purifier in accordance with the inventive disclosures presented herein. the airplane air purifier comprises a ducted housing 1 comprising a contained passageway for air to flow from an air inlet end 2, through the purifier and then exiting the air outlet end or diffuser 6.

Upon entering the purifier, the air flow first encounters the germicidal treatment portion 3 of the purifier. The germicidal section having an ultraviolet (UV) lamp 18 which emits short wavelength UV light in the germicidal spectrum (UVC). For highest germicidal efficiency the UVC light source ideally has a peak emission at around 260 to 270 nm wavelength. The germicidal treatment portion surrounding the UVC light source is provided with a UVC reflective material liner so as to multiply by reflection the germicidal effect of the UV lamp emissions. The UVC lamp is electrically powered by the germicidal lamp power converter 32.

The air flow next enters the ionic air purification portion 4 of the purifier and passes through one or more ionizing wires 14. The ionizing wires 14 are energized at a relatively high voltage of several thousand volts. The ionizing wires impart an electrical charge to the molecules air flow, creating charged molecules known as ions, some of which eventually cling to airborne particles. A corona created on the ionizing wires generates ozone, which is capable of chemically reacting with organic molecules so as to break down organic contaminants, this in addition to the germicidal action of the earlier UVC lamp. The air flow next encounters the electric precipitator 15 or particle collection plates, which are energized in a polarity opposite to that of the ionizing wires 14. The oppositely charged collection plates 15 attract the airborne particles charged by the ionizing wires and due to the static charge thereon from the inverter of the air purifier, deposits the particles removed from the air stream onto the precipitator plates 15. The ionizing and precipitator plates are energized by a high voltage inverter 16 and a rectifier 17. The inverter 16 converts the power supply to the higher voltage required for the ionic air purification. The rectifier 17 converts the output of the inverter to a direct current high voltage supply to charge the ionic wires 14 and collection plates 15.

After leaving the ionic purification portion of the air purifier, the air flow then enters the ozone and chemical filtration portion 5 of the purifier containing an activated charcoal filter to help remove odors that may have made it past the ionic purifier, as well as to remove ozone to the greatest extent practical. The activated charcoal filter 19 has a limited life and is therefore replaceable by the user. The air leaving the air outlet 6 or diffuser is purified air ready to be dispersed into the breathing space of the airplane passenger. Power switch 20 is available to turn the purifier on or off.

Figure 2:
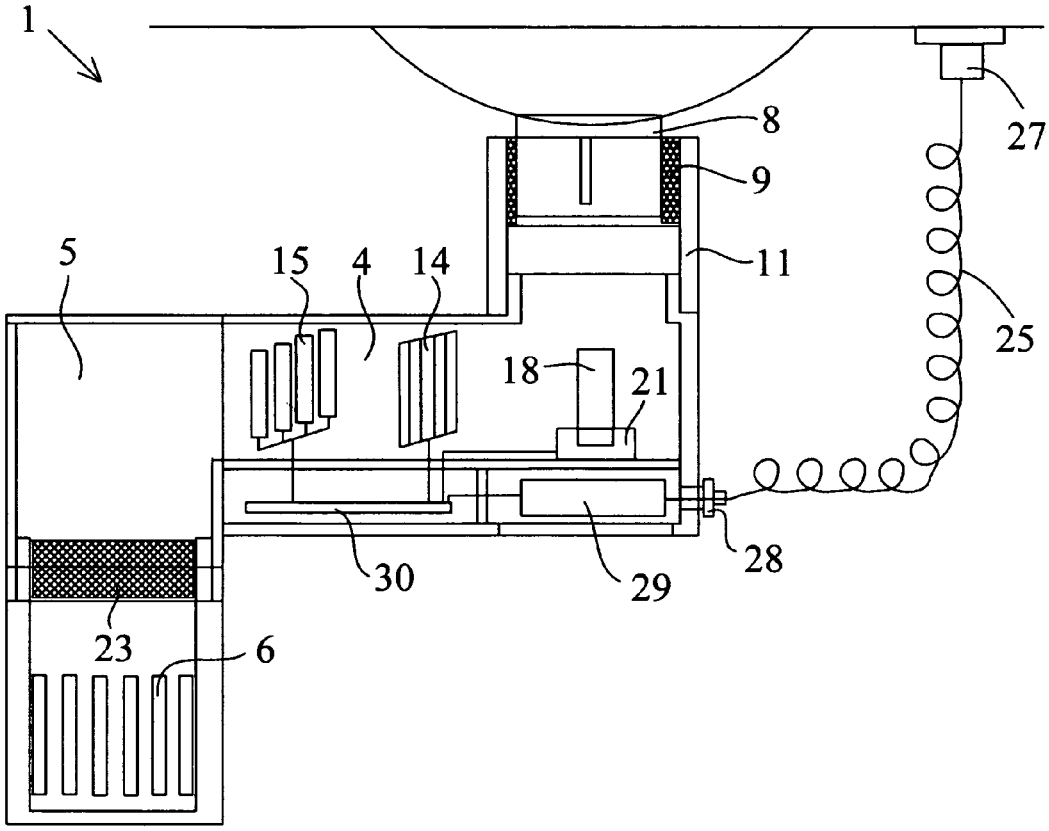
FIG. 2 depicts a cutaway view of one particular embodiment of the airplane air purifier in accordance with the inventive disclosures herein.

FIG. 2 depicts a cutaway view of one particular embodiment of the airplane air purifier in accordance with the inventive disclosures herein. In this embodiment, but not in all embodiments, the airplane air purifier ducted housing 1 comprises a 'Z' shaped housing. The 'Z' shaped housing reduces the overall height of the purifier, while allowing space for required components and thereby reduces the intrusion into the passenger's head room space above the passenger seat. The ducted air housing 1 has an aircraft nozzle adapter 11 which is threadably and removably secured to the ducted housing of the purifier. The nozzle adapter is adapted to supportively and removably engage with the aircraft passenger air vent nozzle 8, in the illustrated case this is an eyeball type nozzle commonly used in passenger aircraft. The nozzle adapter 11 is provided with a pliable rubber donut seal interposed between the body of the nozzle adapter 11 and the aircraft passenger air vent nozzle 8. The donut seal provides a supportive closure between the nozzle 8 and the nozzle adapter 9 so as to supportively secure the purifier to the airplane air vent. Below the nozzle adapter 11 is the germicidal treatment portion 3 of the air purifier, comprising a UVC spectrum germicidal portion 3 is a UVC reflective coating or film. The ionic air purification portion 4 comprises a set of ionizing wires 14 placing a charge on the air stream which then encounters a set of oppositely charge precipitator plates 15. Airflow leaving the precipitator plates then enters the ozone and chemical filtration portion 5 having an activated charcoal filter 23 for removal of residual chemicals missed by the ionic purifier, odors as well as ozone. The air is dispersed into the plane passenger's breathing space through outlet air diffuser 6. The diffuser is threadably and removably secured to the air purifier ducted housing to permit the user to replace the activated charcoal filter 23 on a periodic basis. Electrical power cable 25 connects the airplane air purifier to the aircraft cabin electrical supply. The cable is equipped to be removably connect able at both the aircraft overhead electrical connector 26 and a power connector 27 located on the airplane air purifier. Battery pack 29 powers the air purifier when external electrical power is unavailable. Voltage step-up inverter circuit board 30 provides the high voltage required to drive the ionizing wires 14 and precipitator plates 15.

The illustrated exemplary embodiment is only a possible embodiment of the inventive concepts and disclosure presented herein. The invention is not limited to the physical shape and configuration depicted, to the contrary, the inventive disclosure presented herein may be realized in various physical housings. The invention breadth is covered by the claims presented herein.

The discussed construction, illustrations and sequence of operation is for one embodiment of the invention but is in no way limiting to other embodiments. The operating modes may be changed and enhanced without deviating from the intention of this inventive disclosure.

In the preceding detailed description, reference has been made to the accompanying drawings that form a part hereof and in which are shown by way of illustration specific embodiments in which the invention may be practiced. These embodiments and certain variants thereof have been described in sufficient detail to enable those skilled in the art to practice the invention. It is to be understood that other suitable embodiments may be utilized and that electrical, electronic, logical, material, and mechanical changes may be made without departing from the spirit or scope of the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. An airplane air purifier for removal of contaminants from a passenger air vent air stream, the purifier comprising:

a ducted air housing having an air inlet end, a germicidal treatment portion, an ionic purification portion, an ozone and chemical filtration portion and an outlet air diffuser taken in sequence;

a means of removably and supportively coupling the inlet end of the housing to a ducted aircraft air vent nozzle;

an electrical power source;

a voltage inverter for converting low voltage DC to a high voltage to ionize the air stream; and an ionizing air cleaner comprising:

an air ionizing member to electrically charge the air stream;

a plurality of electric precipitator plates located downstream of the ionizing member, the plates for attracting and removing contaminants from the air stream; and a user replaceable activated carbon charcoal filter for removing remaining ozone and odors from the air stream, wherein the air purifier removes or neutralizes contaminants from the air passing through it, and wherein the purified air is diffused into the breathing space of the passenger.

2. The airplane air purifier of claim 1, wherein the means for removably and supportively coupling the inlet end comprises:

a plurality of nozzle adapters, the adapters removably connect able to the air inlet end of the purifier, each nozzle adapter sized adapted to interface to and supportively attach the air purifier to at least one type of aircraft passenger vent nozzle, wherein the air purifier is attachable to common varieties of aircraft air vent nozzles in use today.

3. The airplane air purifier of claim 2, further comprising:

an ultraviolet UVC germicidal light source for destroying germs, viruses, and bacteria in the air stream, the light source mounted near the inlet side of the housing; and an ultraviolet reflective layer disposed on interior walls of the germicidal portion of the housing, the reflective layer to increase the germicidal effect of the light source by reflecting UVC light source radiation from the interior walls back into the germicidal portion such as to further irradiate the ducted air flow.

4. The airplane air purifier 3, wherein at least one nozzle adapter comprises a pliant tubular coupling having a ratchet clamp thereon, the pliant coupling sized to fit over an aircraft passenger seat eyeball type air vent nozzle, the coupling having a tubular rubber compression doughnut seal secured therein, the seal interposed between the coupling and the air vent, the ratchet clamp circumferentially compressable and latch able so as to compress the pliant tubular coupling seal and sealably mount the tubular coupling onto an outer periphery surface of the air vent.

5. The airplane air purifier of claim 4, wherein the electrical power source comprises the aircraft electrical system.

6. The airplane air purifier of claim 5, wherein the germicidal light source is a low voltage small form ultraviolet UVC wavelength rated mercury arc lamp suitable for embodiments having a small housing size.

7. The airplane air purifier of claim 4, wherein the germicidal light source is one or more ultraviolet UVC wavelength rated light emitting diodes.

8. The airplane air purifier of claim 7, wherein the electrical power source comprises batteries within the purifier housing.

* * * * *